US008232960B2

(12) United States Patent
Fricke et al.

(10) Patent No.: US 8,232,960 B2
(45) Date of Patent: Jul. 31, 2012

(54) DISPLAYING ELECTROPHORETIC PARTICLES

(75) Inventors: Peter J. Fricke, Corvallis, OR (US); Alan R. Arthur, Salem, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 960 days.

(21) Appl. No.: 12/251,076

(22) Filed: Oct. 14, 2008

(65) Prior Publication Data

US 2010/0090944 A1 Apr. 15, 2010

Related U.S. Application Data

(60) Provisional application No. 61/001,394, filed on Nov. 1, 2007.

(51) Int. Cl.
*G09G 3/34* (2006.01)

(52) U.S. Cl. ..... 345/107; 345/36; 345/45

(58) Field of Classification Search ..... 345/107, 345/36, 45

See application file for complete search history.

(56) References Cited

U.S. PATENT DOCUMENTS

| | | | | |
|---|---|---|---|---|
| 6,831,710 | B2 * | 12/2004 | den Boer | 349/48 |
| 6,839,158 | B2 | 1/2005 | Albert et al. | |
| 6,885,495 | B2 | 4/2005 | Liang et al. | |
| 7,110,164 | B2 | 9/2006 | Paolini, Jr. et al. | |
| 7,116,318 | B2 | 10/2006 | Amundson et al. | |
| 7,176,880 | B2 * | 2/2007 | Amundson et al. | 345/107 |
| 7,230,750 | B2 | 6/2007 | Whitesides et al. | |
| 7,968,887 | B2 * | 6/2011 | Mathea et al. | 257/72 |
| 2006/0202949 | A1 | 9/2006 | Danner et al. | |
| 2007/0002009 | A1 | 1/2007 | Pasch et al. | |
| 2007/0057905 | A1 * | 3/2007 | Johnson et al. | 345/107 |

* cited by examiner

*Primary Examiner* — Amare Mengistu
*Assistant Examiner* — Shawna Stepp Jones

(57) ABSTRACT

Among various embodiments of the present disclosure, displaying electrophoretic particles can be performed by configuring an electrophoretic display for directed spreading of electrophoretic particles across a number of substantially planar display electrodes. Such a configuration can be accomplished by controlling planar spreading of the electrophoretic particles in an electrophoretic pixel with an electrical field between an in-plane storage electrode and an in-plane activation electrode. The in-plane activation electrode can be connected to an in-plane display electrode, which extends across a first area in the electrophoretic pixel adjacent to a display aperture having a second area that is substantially coextensive with the first area.

23 Claims, 5 Drawing Sheets

DISPLAYING ELECTROPHORETIC PARTICLES

CROSS REFERENCE TO RELATED APPLICATIONS

This Application claims the benefit of U.S. Provisional Application Ser. No. 61/001,394, filed Nov. 1, 2007, titled "Displaying Electrophoretic Particles" which is hereby incorporated by reference herein as if reproduced in full below.

An electrophoretic display device can present information (e.g., text and/or images) to a viewer by rearranging electrically-charged particles using an applied electric field. In some implementations, an electrophoretic display may have small white particles that carry the electrical charge and these electrophoretic particles may be dispersed (e.g., colloidally suspended) in a dielectric fluid. This mixture may be placed between a pair of parallel conductive plates and, when a voltage is applied across the plates, the electrophoretic particles can migrate to the plate bearing an opposite charge to that of the electrophoretic particles.

When the electrophoretic particles have migrated toward a viewing surface of a display pixel, which may, in some instances, be visualized as a top surface of a page of paper, the surface can appear white because white light is reflected by and/or transmitted through the white electrophoretic particles to the viewer. When the electrophoretic particles have migrated toward the opposite surface, which may be visualized as a bottom surface of the page of paper, the pixel can appear dark due to incident light being absorbed by a dark-colored dielectric fluid. Using many such pixels, text and/or an image can be formed by applying appropriate voltage to each to create a pattern of reflecting/transmitting and absorbing regions.

However, such an electrophoretic display device may use substantial electrical power and/or a high refresh rate to retain the electrophoretic particles at the top viewing surface. Color reproduction can be limited by, among other factors, pixels having color filters that impart a color to the white electrophoretic particles, which may subtract from an intensity of and/or polarize such light. In addition, each pixel may reflect and/or transmit a single color of light, such that a number of adjacent pixels capable of providing different colors (e.g., red, green, and blue) have to be used to additively reproduce an input color, which may limit the intensity of reproduced color per unit area of the viewing surface and/or accuracy of the color reproduction of such an electrophoretic display device.

DETAILED DESCRIPTION

The present disclosure describes an electrophoretic display in which an active matrix backplane (AMBP) uses transistors to integrate with in-plane electrodes that can use individual electrical fields to control spreading of electrophoretic particles across a substantially planar surface of a number of electrophoretic pixels. By stacking a number of these substantially planar arrays of the electrophoretic pixels, having electrophoretic particles that reflect and/or transmit different colors, in various embodiments, a gamut of colors can be produced by a subtractive color process. Such a technology can, among various other implementations, be used to mimic the appearance of text and/or images on paper (e.g., using ink) because colors of an original document can be reproduced and the electrophoretic display may, in some situations, approach the thickness of paper and/or be relatively flexible (e.g., compared to a cathode ray tube monitor).

Accordingly, among various embodiments of the present disclosure, displaying electrophoretic particles can be performed by configuring an electrophoretic display for directed spreading of electrophoretic particles across a number of substantially planar display electrodes. Such a configuration can be accomplished by controlling planar spreading of the electrophoretic particles in an electrophoretic pixel with an electrical field between an in-plane storage electrode and an in-plane activation electrode. The in-plane activation electrode can be connected to an in-plane display electrode, which extends across a first area in the electrophoretic pixel adjacent to a display aperture having a second area that is substantially coextensive with the first area.

Figure 1:
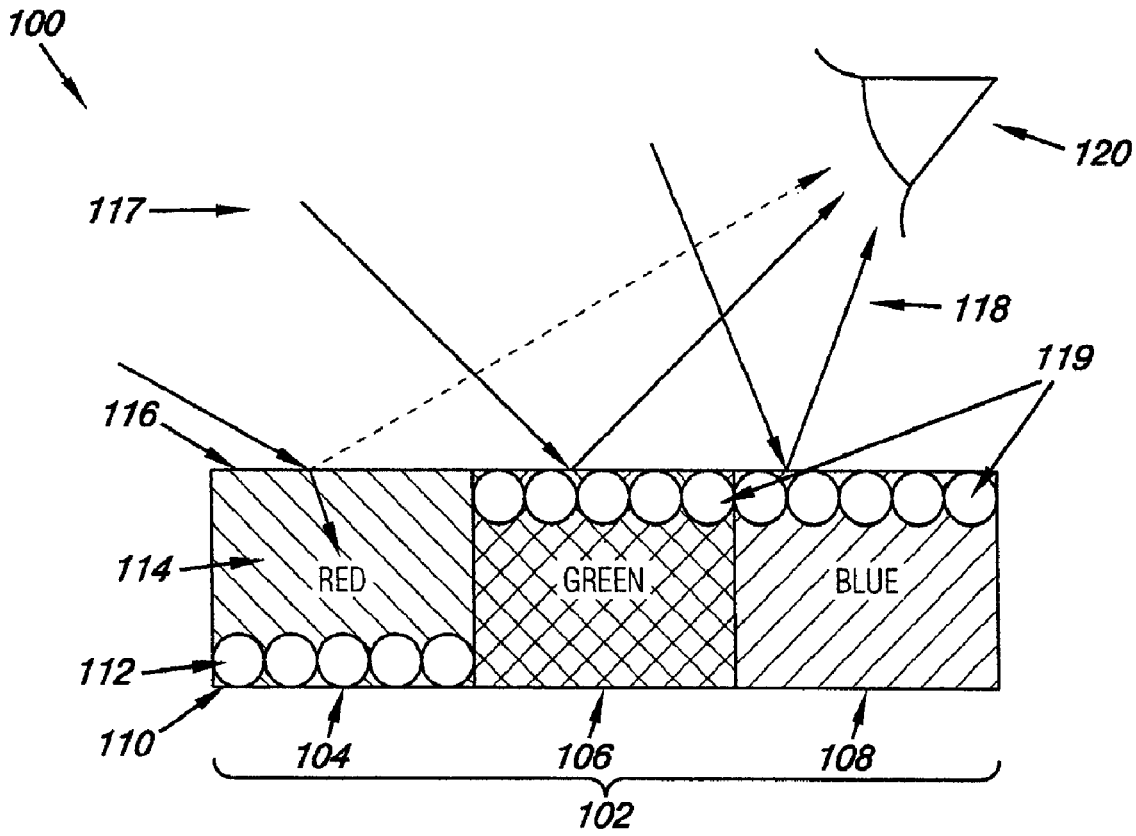
Fig. 1 PRIOR ART
FIG. 1 illustrates an example of an electrophoretic display as described in prior disclosures.

FIG. 1 illustrates an example of an electrophoretic display as described in prior disclosures. FIG. 1 shows by way of illustration how the electrophoretic display 100, in some instances, may use electrical fields in pixels to control out-of-plane (e.g., vertical) migration of electrophoretic pixels from a bottom surface of a pixel to a top surface of the pixel, which can correspond to the viewing surface of the pixel.

The electrophoretic display 100 illustrated in FIG. 1 shows a triad of electrophoretic pixels 102 that use, for instance, a pixel capable of contributing red reflected light 104, a pixel capable of contributing green reflected light 106, and a pixel capable of contributing blue reflected light 108. Combining various intensities of light reflected by the red 104, green 106, and blue 108 pixels of the triad 102 can, by an additive color process, allow creation of a range of different colors that can be perceived by a viewer.

As shown in the red pixel 104, which is representative of the other two pixels of the triad 102, a bottom surface 110 may have a number of charged electrophoretic particles 112 associated therewith. In some implementations, the bottom surface 110 of the red pixel 104 may have a lower electrode plate (not shown) associated therewith to attract and/or repel the charged electrophoretic particles 112.

Attracting and/or repelling the charged electrophoretic particles 112 with the lower electrode plate may cause the charged electrophoretic particles 112 to migrate through a dielectric fluid 114. The dielectric fluid 114 (e.g., a polymer, an oil, etc.) may be dark-colored such that the dielectric fluid 114 absorbs incident light 117 and/or reflects light 118 that may be reflected from an electrophoretic particle, such as the electrophoretic particles 112 associated with the bottom surface 110 of the red pixel 104.

A top surface 116 of the red pixel 104 may, in some instances, have an upper electrode plate (not shown) associated therewith that also can attract and/or repel the charged electrophoretic particles 112. Attracting and/or repelling the charged electrophoretic particles 112 with the upper electrode plate may cause the charged electrophoretic particles 112 to migrate through the dielectric fluid 114.

The top surface 116 of the red pixel 104 also may be the viewing surface for the pixels (e.g., red pixel 104). Accordingly, the top surface 116 may be, or may have a portion that is, at least partially transparent to incident light 117 and/or reflected light 118.

The illustration of FIG. 1 shows the incident light 117 to be coming from above the electrophoretic display 100, which may allow the incident light 117 to transit the transparent portion of the top surface 116. However, in some instances, an electrophoretic display similar to that illustrated in FIG. 1 may use a light source for backplane illumination (not shown), which could cause light to enter a transparent or translucent portion of the bottom surface 110 and exit the transparent portion of the top surface 116 of a number of electrophoretic pixels, such as the triad 102 illustrated in FIG. 1.

A pixel in the electrophoretic display 100 illustrated in FIG. 1 may become capable of emitting light of a particular color by, for instance, conferring a substantially red color to the electrophoretic particles 112 in the red pixel 104 such that the electrophoretic particles 112 can transmit and/or reflect predominantly red light. As an alternative arrangement, a substantially red filter (not shown) may be associated with the top surface 116 of the red pixel 104 such that predominantly red light is allowed to transit the substantially red filter from light reflected by, for instance, white electrophoretic particles. Similar arrangements may allow predominantly green light to be transmitted and/or reflected from the green pixel 106, predominantly blue light to be transmitted and/or reflected from the blue pixel 108, and/or pixels of other colors in an electrophoretic display of the type illustrated in FIG. 1.

The implementation of the electrophoretic display 100 illustrated in FIG. 1 shows the electrophoretic particles 112 to be associated with the bottom surface 110 of the red pixel 104. Hence, some or all of the incident light 117 reaching the top surface 116 of the red pixel may transit the transparent portion of the top surface 116 without being reflected by electrophoretic particles associated with the top surface 116.

The dielectric fluid 114 may be a dark-colored liquid that absorbs incident light 117. In that case, little or none of the incident light 117 entering the red pixel 104 may reach the electrophoretic particles 112 and/or be reflected therefrom to become light reflected out 118 of the red pixel 104. The absorption by the dielectric fluid 114 may result in the area of the red pixel 104, as illustrated in FIG. 1, being dark and contributing little or nothing to brightness of the pixel triad 102 perceivable by the viewer 120.

As such, a substantial portion of an electrophoretic display may be predominantly absorbing light rather than reflecting light. As shown in FIG. 1, for instance, one-third of the area of the pixel triad 102 may be predominantly absorbing incident light 117 through the upper surface 116 of the red pixel 104, rather than reflecting light 118, when a color signal input to the pixel triad 102 contains a low red color component resulting in the electrophoretic particles 112 remaining associated with the bottom surface 110 of the red pixel 104.

As illustrated in FIG. 1, the color signal input to the pixel triad 102 may contain substantial green and blue components. As a result, the green pixel 106 and the blue pixel 108 may have a number of electrophoretic particles 119 that have migrated to the top surface of each of the pixels. In contrast to the red pixel 104, incident light 117 transiting an at least partially transparent portion of top surfaces of the green pixel 106 and the blue pixel 108 may become light reflected 118 by the electrophoretic particles 119 near the top surfaces of the green pixel 106 and the blue pixel 108, rather than being absorbed by an intervening layer of the light-absorbent dielectric fluid 114.

In instances where a filter is associated with the top surface of a pixel in order to confer a particular color to light transmitted and/or reflected by the electrophoretic particles, such a filter may reduce intensity of the transmitted and/or reflected light. In some instances, a filter may polarize the transmitted and/or reflected light.

Reducing the intensity of the light and/or polarizing the light may affect brightness, chroma, and/or hue of a color as perceived by the viewer relative to the color signal input. Color reproduction ability may become affected by electrophoretic display technology using such additive color processes because the number of pixels contributing individual colors to the additive total color may be limited, among other reasons, due to factors related in the present disclosure with regard to FIG. 1.

For instance, having a pixel triad with only red, green, and blue pixels positioned alongside each other may limit the color gamut that can be reproduced, while also encountering effects on brightness, chroma, and/or hue of a perceived color of emitted light. Adding additional and/or substitute color pixels to form a pixel quartet, a pixel quintet, etc., in order to enhance color reproduction ability, may exacerbate the described effects on brightness, chroma, and/or hue of the perceived color of emitted light due to, among other reasons, spreading out the area of the pixels contributing the color components.

For instance, when a set of color pixels are side by side, for instance, a change in position of an illuminated portion of the pixel set may be subtly noticeable by the viewer of an overall page of text and/or image. Further, due to the side by side arrangement of the different colored pixels, the granularity or compactness of the pixel array will be several times larger (e.g., the number of different colored pixels to be provided) than an array, for example, of black and white pixels where each pixel is either on (e.g., black) or off (e.g., white).

Figure 2:
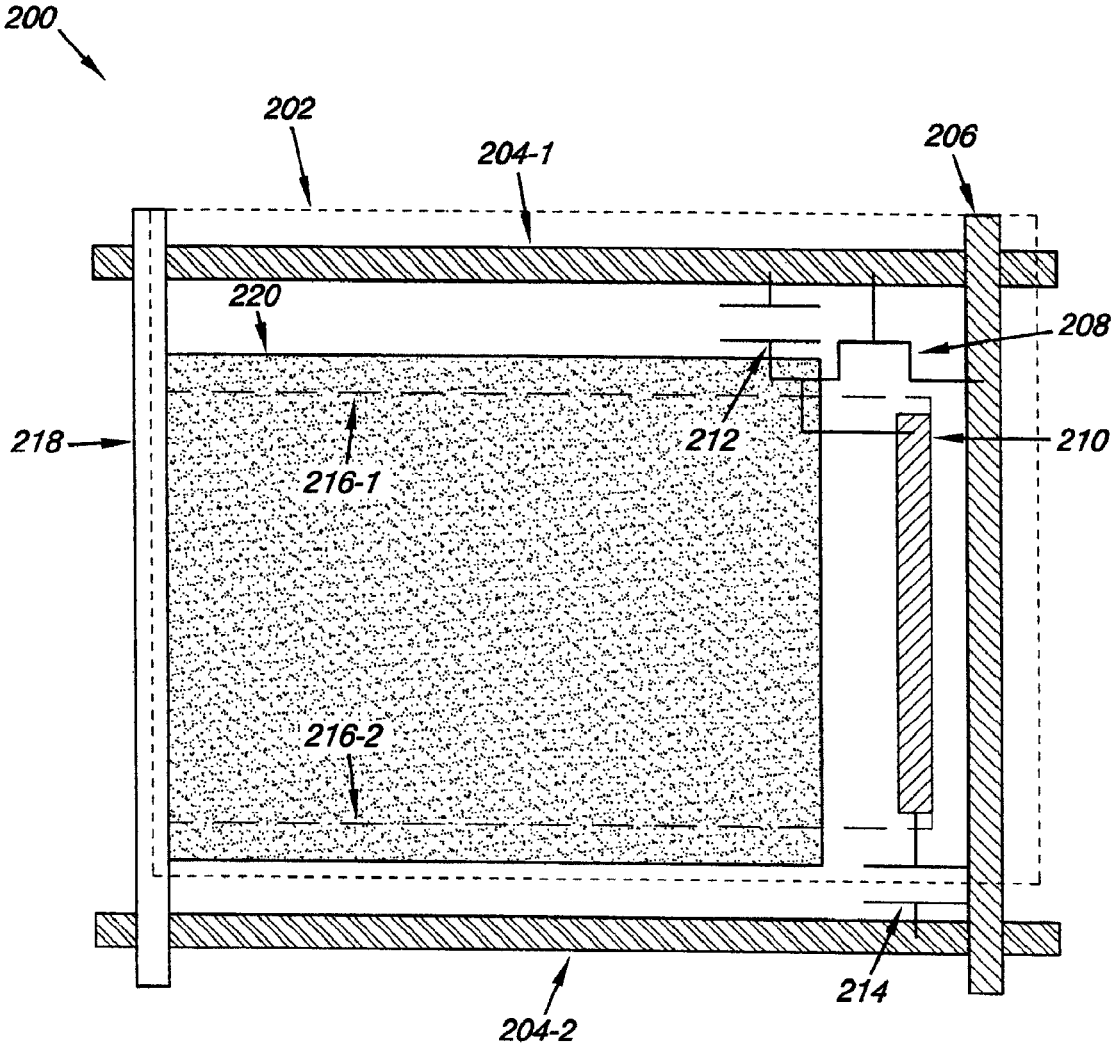
FIG. 2 illustrates an embodiment of circuitry and associated components that are operable to implement one or more embodiments of the present disclosure.

FIG. 2 illustrates an embodiment of circuitry and associated components that are operable to implement one or more embodiments of the present disclosure. FIG. 2 illustrates that, among various embodiments, the circuitry and associated components 200 of the present disclosure can be included in an electrophoretic pixel 202. Electrical pulses transmitted to the electrophoretic pixel 202 can, in various embodiments, be used to control spreading of electrophoretic particles (not shown) in an x-y plane across a display electrode 220 of the electrophoretic pixel 202.

In various embodiments, the electrophoretic pixel 202 illustrated in FIG. 2 can include a first select line 204-1. The first select line 204-1 shown among the circuitry and associated components 200 can be used for transmitting a subset of electrical pulses, which can originate in a data line 206 associated with the electrophoretic pixel 202, to a storage electrode 210 of the electrophoretic pixel 202.

A first set of the electrical pulses can be transmitted from a data line 206 to a source terminal for a transistor 208, which can, in various embodiments, be a thin film transistor (TFT), as described in the present disclosure. A drain terminal for the TFT 208, for example, can be connected to an in-plane storage electrode 210, where, in various embodiments, the in-plane storage electrode 210 can be connected to a storage capacitor 214, as described with regard to FIGS. 3A-3C.

As illustrated in FIG. 2, the first set of electrical pulses, having been modulated by coupling through a parasitic capacitor 212 connected to the drain terminal of the transistor 208, can, in various embodiments, be transmitted as a second set of electrical pulses to the in-plane storage electrode 210 when a select line 204-1 activates the transistor 208 (e.g., acting as a TFT switch). In various embodiments, the electrical pulses (e.g., data voltage from the data line 206) can be modulated by coupling through the parasitic capacitor 212 which is connected from the drain terminal of the TFT and to the gate electrode of the TFT. In various embodiments, the gate electrode of the TFT 208 can be connected to the first select line 204-1, the source terminal thereof can be connected to the data line 206, and the drain terminal thereof can be connected to the in-plane storage electrode associated with the electrophoretic pixel 202.

An in-plane activation electrode 218 can, in various embodiments, provide an opposing voltage, opposite that of the in-plane storage electrode 210, to attract electrophoretic particles (not shown) from the in-plane storage electrode 210 or repel the electrophoretic particles to the in-plane storage electrode 210. In some embodiments, the in-plane activation electrode 218 can be shared with one or more adjacent electrophoretic pixels (not shown).

The in-plane activation electrode 218 can, in various embodiments, facilitate control of spreading of electrophoretic particles in an x-y plane (i.e., in-plane) across an in-plane display electrode 220 by using a third set of electrical pulses transmitted to the electrophoretic pixel 202. In various embodiments, the in-plane activation electrode 218 can receive the third set of electrical pulses from a source (not shown) outside the electrophoretic pixel 202 (e.g., from circuitry associated with the AMBP). The third set of electrical pulses can be used to facilitate, for example, in-plane spreading and/or biasing of the electrophoretic particles involved in forming text and/or images, as well as erasing such, among other functions.

In some embodiments, the in-plane display electrode 220 can be configured as substantially planar and the in-plane activation electrode 218 can be substantially in-plane with the in-plane display electrode 220 to which it is connected. As such, as described in the present disclosure, the third set of electrical pulses can be transmitted to the in-plane activation electrode 218 to control a manner of in-plane spreading of the electrophoretic particles across the in-plane display electrode 220 that is connected to the in-plane activation electrode 218.

The circuitry and associated components 200 of the electrophoretic pixel 202 can, in various embodiments, include the in-plane storage electrode 210. The in-plane storage electrode 210 can, in some embodiments, be controlled by transmitting electrical pulses through the data line 206 connected through the gate electrode of the TFT 208 to the in-plane storage electrode 210. The in-plane storage electrode 210 can, in some embodiments, be substantially coplanar with the in-plane display electrode 220 and the in-plane activation electrode 218.

The in-plane storage electrode 210 can, in some embodiments, be connected to a storage capacitor 214. The storage capacitor 214 can, in some embodiments, also be connected to a second select line 204-2.

The second select line 204-2 can, in some embodiments, be located outside a boundary of the electrophoretic pixel 202, as illustrated in the embodiment of FIG. 2. In some embodiments, the second select line 204-2 can serve as an equivalent of the first select line 204-1 to an adjacent electrophoretic pixel (not shown).

An electrophoretic pixel, as described in the present disclosure, can include a well in which a number of electrophoretic particles are contained. The electrophoretic particles can be dispersed in the well in a dielectric fluid, in various embodiments, through which the electrophoretic particles can be directed to spread out in response to an applied electrical field.

In embodiments of the present disclosure, the electrophoretic particles can be directed to spread across a well substantially defined by, as illustrated in FIG. 2, boundaries that include a plane of the in-plane display electrode 220, a first end at least partially formed from the in-plane storage electrode 210, and a second end at least partially formed from the in-plane activation electrode 218. In various embodiments, the well can include a gap between the in-plane storage electrode 210 and the in-plane display electrode 220, as illustrated in FIG. 2. The in-plane activation electrode 218 can, in various embodiments, be connected to the in-plane display electrode 220, as further illustrated in FIG. 2.

For purposes of illustration and not by way of limitation, the embodiment illustrated in FIG. 2 shows the sides of the well 216-1, 216-2 positioned interior to the side edges of the in-plane display electrode 220 and extending from the in-plane activation electrode 218 to slightly outside the ends of the in-plane storage electrode 210. Various embodiments, however, can have the sides of the well positioned differently from the electrophoretic pixel 202 embodiment shown in FIG. 2.

An electrophoretic pixel, as described in the present disclosure, can assume any orientation relative to gravitational pull and/or a position of the viewer. For purposes of illustration, however, FIG. 2 can represent a top view of the circuitry and associated components 200 of the electrophoretic pixel 202. Accordingly, a first substantially transparent display aperture (not shown) can, in various embodiments, be positioned on the top of the electrophoretic pixel 202 so as to allow incident light to reach electrophoretic particles spread across the well and to allow light reflected by the electrophoretic particles to exit the electrophoretic pixel 202 and to be viewable by the viewer.

In some embodiments, a second substantially transparent display aperture (not shown) can be positioned on the bottom surface of the electrophoretic pixel 202 so as to allow transit of incident light coming from underneath the electrophoretic pixel 202. For example, as described in the present disclosure, light coming from below electrophoretic pixel 202 can come from a backlight source (not shown) and/or from another electrophoretic pixel (not shown) positioned below the electrophoretic pixel 202. To enable transit of light coming from below the electrophoretic pixel 202, the in-plane display electrode 220 can be formed from an at least partially transparent material (e.g., indium tin oxide, among other suitable compounds).

In various embodiments, display apertures can have borders and/or be positioned such that many of the electrophoretic particles directed to spread across a display electrode are accessible to light transiting an adjacent display aperture and can, in some embodiments, reflect a portion of such light back through the display aperture, which can be seen by a viewer. In some embodiments, electrophoretic particles spread across a substantially transparent display electrode positioned above a first display aperture can cause light supplied by a backlight source positioned below the first display aperture to be transmitted therethrough and emitted through a second display aperture to be viewable by the viewer. In various embodiments, the first and second display apertures can be directly aligned with each other, offset from each other, or otherwise positioned.

In various embodiments, display apertures can have borders and/or be positioned such that few of the electrophoretic particles stored in association with an in-plane storage electrode are accessible to light transiting an adjacent display aperture and, therefore, can reflect and/or transmit little of such light through the display aperture. As such, the positioning of a display aperture adjacent to an in-plane storage electrode can limit an amount of light reaching the viewer from stored electrophoretic particles that have not been directed to spread across the display electrode in response to a color component of signal input.

Figure 3A:
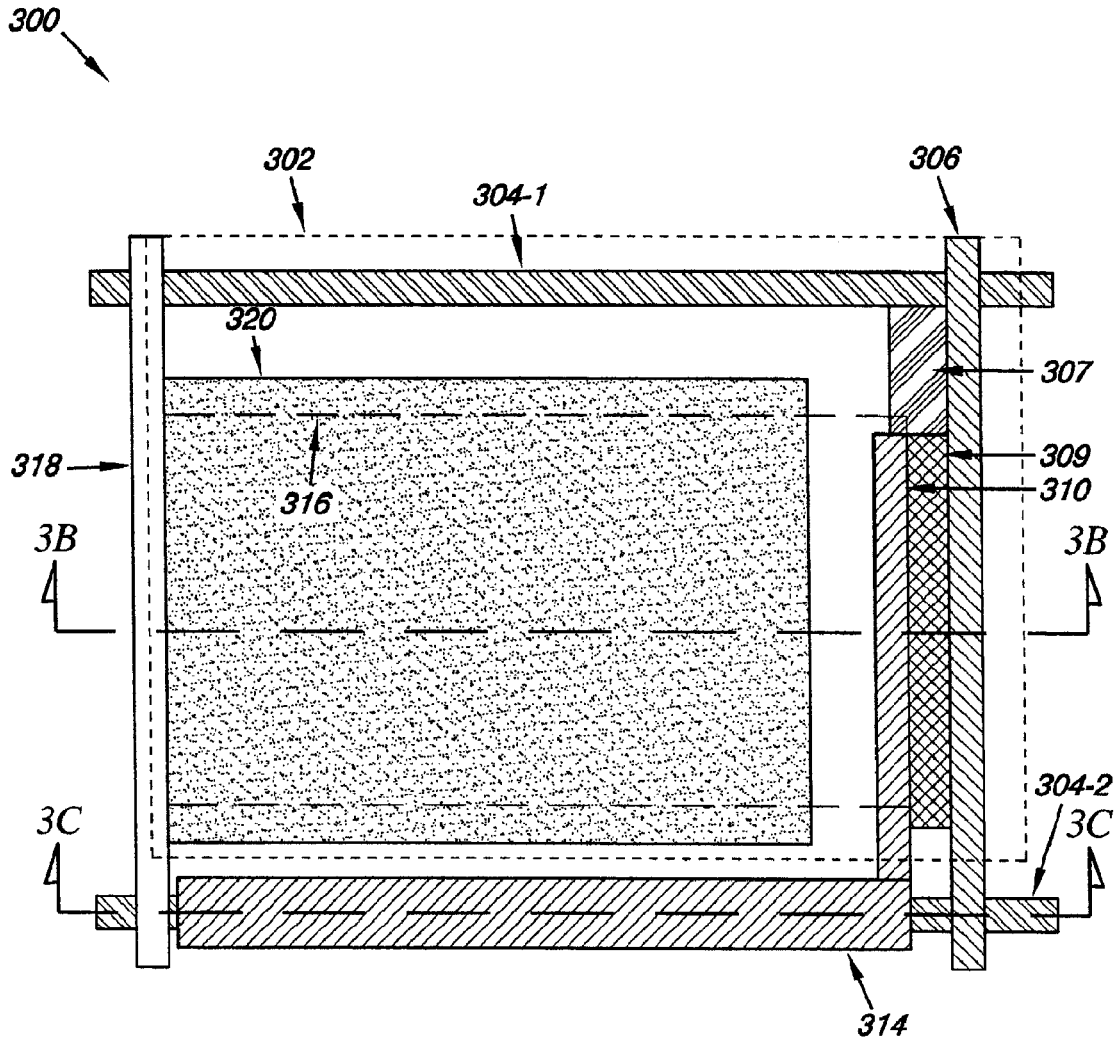
FIG. 3A illustrates a top view of an embodiment of circuitry and associated components that are operable to implement one or more embodiments of the present disclosure.

FIG. 3A illustrates a top view of an embodiment of circuitry and associated components that are operable to implement one or more embodiments of the present disclosure. FIG. 3A illustrates that, among various embodiments, the circuitry and associated components 300 of the present disclosure can be included in an electrophoretic pixel 302 and/or associated therewith. In some embodiments, the electrophoretic pixel 302 illustrated in FIG. 3A can include circuitry and associated components as shown in FIG. 2, in addition to further circuitry and components included therein and/or associated therewith, as described in the present disclosure.

In some embodiments, the illustration of circuitry and associated components 300 as shown in FIG. 3A can represent a top view relative to the plane of the display electrode 320. That is, the illustration of circuitry and associated components 300 may not be a top view of the electrophoretic pixel 302 in the electrophoretic display because the plane may assume a number of orientations relative to a viewer during use.

In various embodiments, the electrophoretic pixel 302 illustrated in FIG. 3A can include a first select line 304-1. As described with regard to FIG. 2, the first select line 304-1 shown among the circuitry and associated components 300 in FIG. 3A can be used for transmitting electrical pulses, which can originate in a data line 306 associated with the electrophoretic pixel 302, to a storage electrode 310 of the electrophoretic pixel 302.

As also described with regard to FIG. 2, the electrical pulses can, in some embodiments, be modulated through a parasitic capacitor connected to a drain terminal to couple the first select line 304-1 to the storage electrode 310, as shown in FIG. 3A For purposes of illustration in FIG. 3A, the combination of the parasitic capacitor and/or the gate electrode illustrated in FIG. 2 is shown as a single component 307. The single component 307 illustrated in FIG. 3A can, in various embodiments, be positioned below a plane defined substantially by a bottom surface of a well 316 and the display electrode 320 included in the electrophoretic pixel 302 to contribute to formation of a bottom gate TFT, as described in the present disclosure.

As further described with regard to FIG. 2, the activation electrode 318 shown in FIG. 3A can, in various embodiments, facilitate control of spreading of electrophoretic particles in an x-y plane across the display electrode 320 by using electrical pulses transmitted to the electrophoretic pixel 302. In some embodiments, the display electrode 320 can be substantially planar and the activation electrode 318 can be substantially in-plane with the display electrode 320 to which it is connected.

The display electrode 320 can be, in various embodiments, substantially in-plane and/or coplanar with the well 316 in which electrophoretic particles (not shown) and dielectric fluid (not shown) are housed. As used in the present disclosure, in-plane used as an adjective indicates elements that are substantially parallel to a particular plane of reference (e.g., a plane of reference defined by a planar display electrode). Out-of-plane used as an adjective indicates elements at a substantial angle (e.g., 90 degrees) to the plane of reference.

As further described with regard to FIG. 2, the circuitry and associated components 300 of the electrophoretic pixel 302 shown in FIG. 3A can, in various embodiments, include a storage electrode 310. The storage electrode 310 can, in various embodiments, be controlled by transmitting electrical pulses through the select line 304-1 and/or the data line 306 connected through component 307, which can include the gate electrode for the bottom gate TFT, to the storage electrode 310.

The storage electrode 310 can, in some embodiments, be substantially in-plane with the display electrode 320 and the activation electrode 318. The storage electrode 310 can be, in various embodiments, substantially in-plane and/or coplanar with the well 316 in which electrophoretic particles and dielectric fluid are housed.

In various embodiments, a semiconductor channel 309 can be positioned between the data line 306 and the storage electrode 310. As illustrated in the embodiment shown in FIG. 3A, the semiconductor channel 309 can, in some embodiments, be placed in contact on a first side with the data line 306 and in contact on a second side with the storage electrode 310, with the semiconductor channel 309 being interposed between the data line 306 and the storage electrode 310.

As appreciated by one of ordinary skill in the relevant art, a semiconductor channel separating a source of electrical pulses from an electrode can serve to function as a switch where an individual electrical pulse having a magnitude that exceeds a particular threshold imposed by the semiconductor channel is allowed passage to the electrode. As such, as illustrated in FIG. 3A, positioning an in-plane semiconductor channel 309 between the in-plane storage electrode 310 and a data line 306 can, in various embodiments, serve as a switch to increase control of the electrical field affecting the in-plane spreading of the electrophoretic particles.

An AMBP having a number of gate electrodes for a plurality of TFTs can, in various embodiments, be integrated with a number of electrophoretic pixels having the remaining components of the plurality of the TFTs by positioning an in-plane semiconductor channel on an in-plane surface of each electrophoretic pixel to form a plurality of bottom gate TFTs. The in-plane semiconductor channel of the bottom gate TFT, the in-plane storage electrode, the in-plane activation electrode, and the in-plane display electrode can, in some embodiments, be positioned on the in-plane surface of each electrophoretic pixel.

In various embodiments, the in-plane semiconductor channel of the bottom gate TFT can be positioned on the in-plane surface by promoting formation and growth of in-plane semiconductor crystal structures on the in-plane surface of each electrophoretic pixel. Semiconductor channels grown as crystal structures on the in-plane surface of an electrophoretic pixel can yield improved performance relative to a preformed semiconductor inserted between an in-plane data line and an in-plane storage electrode. The improved performance can result from an inherent attachment to the in-plane surface of the electrophoretic pixel, a consolidated connection to the in-plane data line and the in-plane storage electrode, and a more ordered structure of the semiconductor channel, among other factors, contributed by forming the semiconductor channels in position and in-plane on the surface of each electrophoretic pixel.

Semiconductor channels usable as described in the present disclosure can be formed from a number of materials. For example, semiconductors can, in various embodiments, be formed from such materials as single elements (e.g., $Si_x$, among others), a single metal oxide (e.g., $In_xO_n$, among others), a binary metal oxide (e.g., $In_xSn_yO_n$, among others), multicomponent metal oxides (e.g., $In_xSn_yGa_zO_n$, among others), other multicomponent inorganic semiconductors, and organic semiconductors regardless of whether formed as single component, bicomponent, and/or multicomponent semiconductors, among other semiconductor formulations known in the relevant art.

In some embodiments, transmitting the electrical pulses sent to an electrophoretic pixel can be supplied to the electrophoretic pixel by transmitting the electrical pulses through a bidirectional bottom gate TFT. The bidirectional bottom gate TFT can, in various embodiments, allow signals to be transmitted that, for example, direct electrophoretic particles to begin spreading from the storage electrode across the display electrode of the electrophoretic pixel toward the activation electrode and/or allow signals to be transmitted that reverse such signals and direct the electrophoretic particles to retreat from the display electrode toward the storage electrode. Electrical pulses transmitted through a bidirectional bottom gate TFT can be transmitted through a multicomponent oxide semiconductor channel, among the various embodiments of semiconductor channels described in the present disclosure.

As illustrated in the embodiment shown in FIG. 3A, the storage electrode 310 can, in various embodiments, be coupled to a storage capacitor 314. In some embodiments, the storage capacitor 314 can be positioned in-plane with the in-plane storage electrode 310, as described in the present disclosure. The storage capacitor 314 can, in various embodiments, be positioned either inside or outside, as illustrated in FIG. 3A, a boundary of an associated electrophoretic pixel, for example, the electrophoretic pixel 302 embodiment shown in FIG. 3A.

Figure 3B:
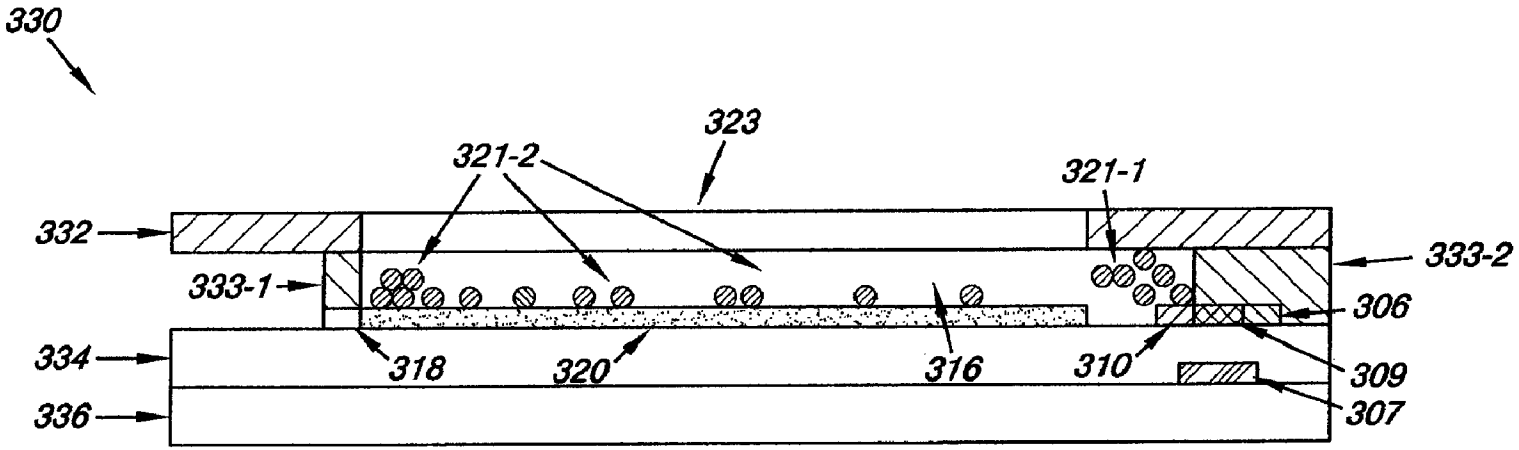
FIGS. 3B and 3C illustrate cut away side views of the embodiment of FIG. 3A taken along lines 3B-3B and 3C-3C, respectively.
Figure 3C:
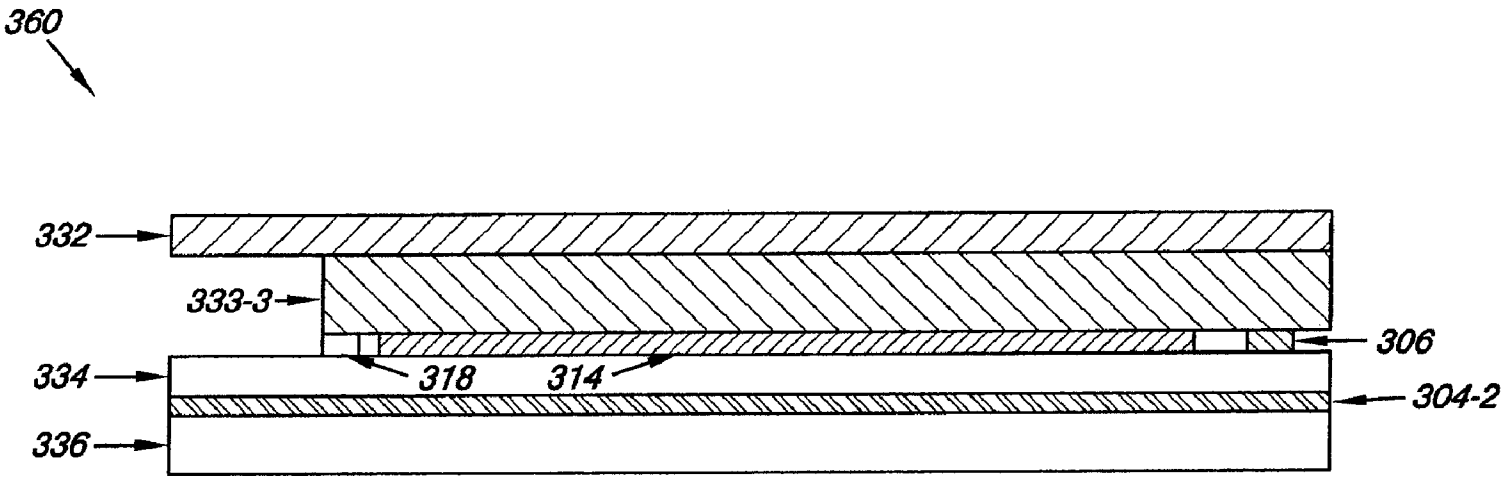

The illustration of circuitry and components 300 associated with the embodiment of the electrophoretic pixel 302 shown in FIG. 3A includes an illustration of the positioning of cut away side views taken along lines 3B-3B and 3C-3C corresponding to the cut away side views of the circuitry and associated components 300 as illustrated in FIG. 3B and FIG. 3C, respectively.

As illustrated in FIG. 3A, and further defined in the embodiment illustrated in FIG. 3C, the storage capacitor 314 can, in some embodiments, be positioned above a second select line 304-2. That is, in some embodiments, the select line 304-2 can be positioned below the circuitry and components 300 associated with the embodiment of the electrophoretic pixel 302 shown in FIG. 3A relative to the in-plane storage capacitor 314. As described with regard to FIG. 2, the second select line 304-2 can, in some embodiments, function as a select line for an adjacent electrophoretic pixel analogous to the function of select line 204-1 illustrated in FIG. 2 and select line 304-1 illustrated in FIG. 3A.

As described in the present disclosure, an in-plane storage electrode, as illustrated in the embodiment shown in FIG. 3A, can be used to control whether the electrophoretic particles are allowed to spread across the display electrode and become visible to the viewer through a display aperture that is substantially coplanar to and coextensive with the display electrode. When the electrophoretic particles are not directed to spread across the display electrode, the electrophoretic particles can be restrained from spreading by remaining associated with the storage electrode. Associating and coupling the in-plane storage electrode with a storage capacitor can, among other functions, reduce a refresh rate of the in-plane storage electrode that may otherwise be used to maintain stability of the electrophoretic particles in association with the storage electrode.

FIGS. 3B and 3C illustrate cut away side views of the embodiment of FIG. 3A taken along lines 3B-3B and 3C-3C, respectively. FIG. 3B illustrates a planar cut away view 330 of an embodiment of circuitry and associated components that intersects the well 316 of the electrophoretic pixel 302, as illustrated in the embodiment shown in FIG. 3A, in addition to the in-plane storage electrode 310, the in-plane activation electrode 318, and the in-plane display electrode 320, among other components, positioned therein.

The well 316 illustrated in the embodiment of the circuitry and associated components 330 of FIG. 3B shows a number of electrophoretic particles 321-1, 321-2 contained therein. The number of electrophoretic particles 321-1 illustrated in association with the in-plane storage electrode 310 and the number of electrophoretic particles 321-2 illustrated in association with the in-plane display electrode 320 and/or the in-plane activation electrode 318, and the positioning and/or relative size of such electrophoretic particles, is shown by way of illustration and not by way of limitation.

For example, one of ordinary skill in the relevant art will appreciate that a well of an electrophoretic pixel can contain many more electrophoretic particles than are shown in the embodiment illustrated in FIG. 3B. Similarly, the relative shape and dimensions of the circuitry and associated components, including electrophoretic particles therein, illustrated in FIGS. 1, 2, and 3A-3C are shown by way of illustration and not by way of limitation.

FIG. 3B illustrates a planar cut away view of an electrophoretic pixel showing a side view, relative to a substantially planar embodiment of the display electrode 320, in which the embodiment includes the data line 306, the semiconductor channel 309, the storage electrode 310, and the activation electrode 318 being positioned substantially coplanar with the display electrode 320. However, the utility of the concept as described in the present disclosure is not dependent upon any particular component of the circuitry being substantially coplanar with a display electrode. As such, the present disclosure is intended to cover all adaptations or variations of the various embodiments described herein.

The embodiment of the circuitry and associated components 330 illustrated in FIG. 3B shows a lid 332 that, in various embodiments, can cover the well 316 containing the electrophoretic particles 321-1, 321-2. The embodiment of the lid 332 illustrated in FIG. 3B can include a substantially transparent display aperture 323 that can, in various embodiments, be positioned above the well 316.

In some embodiments, the display aperture 323 can be configured, as illustrated in FIG. 3B, such that the substantially transparent portion is substantially coextensive and/or coplanar with the adjacent display electrode 320. As described in the present disclosure, an electrophoretic pixel can have a first display aperture positioned along a top surface of an electrophoretic pixel and a second display aperture positioned along a bottom surface of the display pixel such that incident light and/or reflected/transmitted light can pass through the electrophoretic pixel.

In some embodiments, as illustrated in FIG. 3B, the elements of the circuitry and associated components 330 just described can, in various embodiments, be positioned, constructed, and/or grown (e.g., the semiconductor channel 309) on a layer of insulating dielectric material 334. The layer of insulating dielectric material 334 can be separated from the lid 332 by various wall configurations in order to provide a suitably configured volume for the well 316 containing the electrophoretic particles 321-1, 321-2, dielectric fluid, and associated circuitry, among other components, as described in the present disclosure. In some embodiments, a wall 333-1 positioned near the in-plane activation electrode 318 and/or a wall 333-2 positioned near the in-plane storage electrode 310 can contribute to separating the lid 332 and the layer of insulating dielectric material 334 to create the volume for the well 316, as illustrated in FIG. 3B.

The layer of insulating dielectric material 334 additionally can be used to separate and/or insulate a component 307 that contains a gate electrode from the semiconductor channel 309 associated with the data line 306 and the in-plane storage electrode 310. As such, in some embodiments, a bottom gate TFT can be formed for control of the in-plane circuitry of an electrophoretic pixel, as described in the present disclosure.

The component 307, including the gate electrode, can, in various embodiments, be positioned in association with (e.g., on top on a substrate layer 336. The substrate layer 336 can, in various embodiments, be associated with and/or represent an AMBP for a number of electrophoretic pixels, such as the circuitry and associated components 330 of the electrophoretic pixel illustrated in FIG. 3B. In some embodiments, the substrate layer 336 can be formed from a substantially transparent material and/or include a substantially transparent display aperture, as described in the present disclosure.

FIG. 3C illustrates a planar cut away view 360 of an embodiment of circuitry and associated components that intersect the second select line 304-2 and the storage capacitor 314 of the electrophoretic pixel 302, as illustrated in the embodiment shown in FIG. 3A. As such, FIG. 3C illustrates a planar cut away view showing a side view of an edge of an electrophoretic pixel (e.g., relative to a substantially planar embodiment of a display electrode (not shown)) in which the embodiment also includes an intersection of the data line 306 and the activation electrode 318.

Although the storage capacitor 314 is illustrated as being coplanar with the data line 306 and the activation electrode 318, and not coplanar with the second select line 304-2 (and potentially the first select line 304-1 as illustrated in FIG. 3A), the utility of the concept as described in the present disclosure is not dependent upon any particular component of the circuitry being substantially coplanar with or not coplanar with other circuitry and/or associated components. As such, the present disclosure is intended to cover all adaptations or variations of the various embodiments described herein.

As described with regard to FIG. 3B, the embodiment of the circuitry and associated components 360 illustrated in FIG. 3C shows the lid 332 that, in various embodiments, can cover a well containing the electrophoretic particles (not shown). The embodiment of the lid 332 illustrated in FIG. 3C can include a substantially transparent display aperture (not shown) that can be positioned above the well. Although the embodiment of the lid 332 illustrated in FIG. 3B can include a relatively opaque border that shields the display aperture from appearing in a side view, some embodiments of the present disclosure can include various configurations of a lid in which a display aperture occupies various areas thereof, including a configuration in which a substantially transparent display aperture is apparent in a side view, such as that illustrated in FIG. 3C.

As described with regard to FIG. 3B, the embodiment of the circuitry and associated components 360 illustrated in FIG. 3C also shows the layer of insulating dielectric material 334. As shown in the embodiment illustrated in FIG. 3C, elements of the circuitry and associated components 360 (e.g., the data line 306, the storage electrode 314, and/or the activation electrode 318) can, in various embodiments, be positioned, constructed, and/or grown on the layer of insulating dielectric material 334.

The layer of insulating dielectric material 334 can be separated from the lid 332 by various wall configurations, as described in the present disclosure. In some embodiments, a wall 333-3 extending from near the activation electrode 318 to near the data line 306 can contribute to separating the lid 332 and the layer of insulating dielectric material 334 to create a volume for a well (not shown), as illustrated in FIG. 3C.

As further described with regard to FIG. 3B, the layer of insulating dielectric material 334 additionally can be used to separate and/or insulate circuitry components associated with and/or below the layer of insulating dielectric material 334 from circuitry and/or associated components above the layer of insulating dielectric material 334. For example, as illustrated in FIG. 3C, the layer of insulating dielectric material 334 can, in some embodiments, separate and/or insulate components including the in-plane data line 306, the in-plane storage capacitor 314, and/or the in-plane activation electrode 318 from the first select line (not shown) and/or the second select line 304-2.

As further described with regard to FIG. 3B, the substrate layer 336 can, in various embodiments, be associated with and/or represent an AMBP for a number of electrophoretic pixels, such as the circuitry and associated components 360 of the electrophoretic pixel illustrated in FIG. 3C. In some embodiments, as shown in the circuitry and associated components 360 illustrated in FIG. 3C, the first select line (not shown) and/or the second select line 304-2 can be positioned between the layer of insulating dielectric material 334 and the substrate layer 336.

Figure 4:
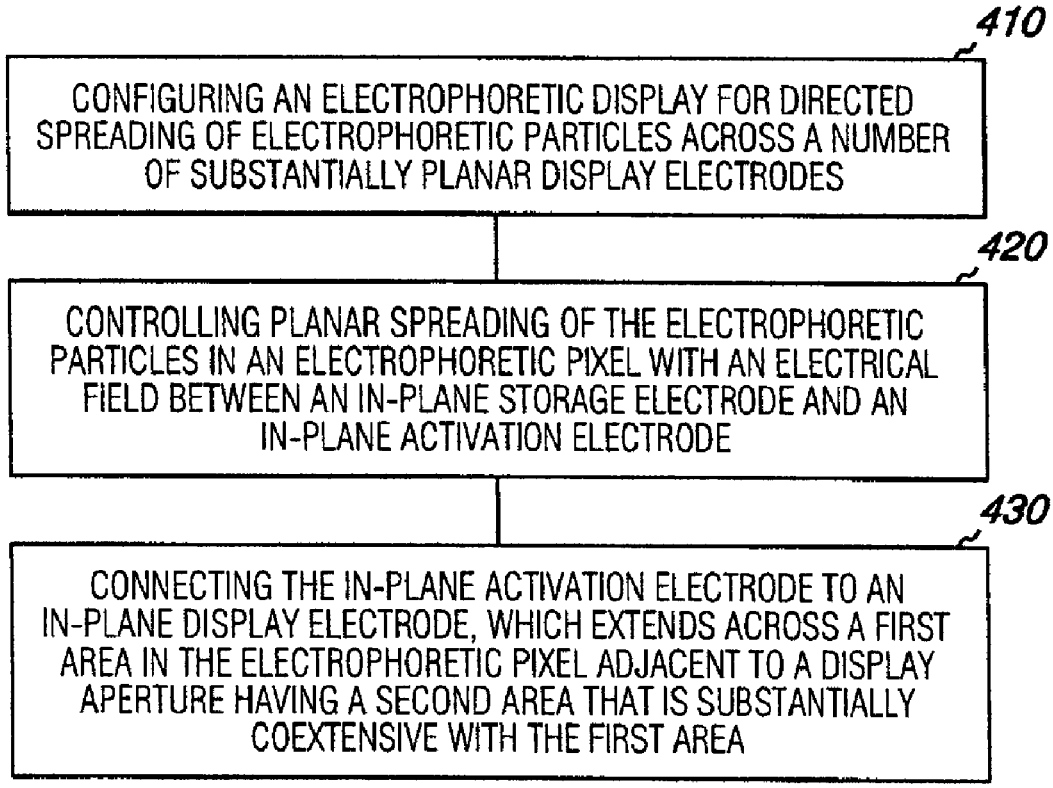
FIG. 4 is a block diagram illustrating a method of displaying electrophoretic particles according to an embodiment of the present disclosure.

FIG. 4 is a block diagram illustrating a method of displaying electrophoretic particles according to an embodiment of the present disclosure. Unless explicitly stated, the method embodiments described herein are not constrained to a particular order or sequence. Additionally, some of the described method embodiments, or elements thereof, can occur or be performed at the same, or at least substantially the same, point in time.

Embodiments described herein can be performed using logic, software, firmware, hardware, application modules, and ASICs, or combinations of these elements, and the like, to perform the operations described herein. Embodiments as described herein are not limited to any particular operating environment or to software/firmware coded and stored in a particular programming language.

The elements described can be resident on the systems, apparatuses, and/or devices shown herein, or otherwise. Logic suitable for performing embodiments of the present disclosure can be resident in one or more devices and/or locations. Processing devices used to execute operations described herein can include one or more individual modules that perform a number of functions, separate modules connected together, and/or independent modules.

The embodiment illustrated in FIG. 4 includes configuring an electrophoretic display for directed spreading of electrophoretic particles across a number of substantially planar display electrodes, as shown in block 410. An example of one suitable type of substantially planar display electrode is shown in the embodiments illustrated in FIG. 2 and FIGS. 3A-3C of the present disclosure. However, the teachings of the present disclosure are not limited to embodiments of the substantially planar display electrodes being a particular shape (e.g., rectangular, square, circular, among other shapes) and/or being entirely planar (e.g., display electrodes can have flanges, lips, ramps, dips, perforations, among other deviations) in order to be considered substantially planar.

Block 420 of the embodiment shown in FIG. 4 includes controlling planar spreading of the electrophoretic particles in an electrophoretic pixel with an electrical field between an in-plane storage electrode and an in-plane activation electrode. In various embodiments, a bistable electrical field can be provided that reduces a refresh rate to maintain a position of the electrophoretic particles by using a storage capacitor connected to the storage electrode and/or a parasitic capacitor connected to the storage electrode.

As such, a refresh rate of the in-plane storage electrode can, in various embodiments, be reduced by associating the in-plane storage electrode with the storage capacitor. Additionally, the refresh rate of the in-plane storage electrode can, in various embodiments, be reduced by associating the in-plane storage electrode with a parasitic capacitor connected to a drain electrode and a select line.

As shown in block 430, the in-plane activation electrode can, in various embodiments, be connected to an in-plane display electrode, which extends across a first area in the electrophoretic pixel adjacent to a display aperture having a second area that is substantially coextensive with the first area. As such, electrophoretic particles can be directed to spread across the in-plane display electrode to become visible through the adjacent display aperture, which can, in various embodiments, be positioned substantially coplanar to the in-plane display electrode.

Controlling spreading of the electrophoretic particles with the in-plane storage electrode can, in various embodiments, include storing the electrophoretic particles outside the first area of the display electrode, which is substantially coextensive with the second area of the display aperture. As such, the stored electrophoretic particles can be stored in a position that is substantially out of the viewer's line of sight when viewing electrophoretic pixels in an electrophoretic display apparatus as described in the present disclosure. In addition, the electrophoretic pixels stored as such can reflect and/or transmit little light through one or more display apertures of the electrophoretic pixel.

In various embodiments, a subset of the electrical pulses can be transmitted to the in-plane storage electrode to control a manner of in-plane spreading of the electrophoretic particles across the display electrode that is connected to the in-plane activation electrode (e.g., to produce grayscale images). Electrical pulse modulation can, in various embodiments, be used to control the manner of in-plane spreading of the electrophoretic particles. As appreciated by one of ordinary skill in the relevant art, electrical pulse modulation techniques, among others can include, in various embodiments: using a number of incremental voltage levels, where the number ranges from two voltage levels to 256 voltage levels, transmitted to the display electrode; using a varying time span of a particular voltage transmitted to the display electrode; using a varying time span of the number of incremental voltage levels transmitted to the display electrode; and/or using waveform diffusion mechanisms.

As described in the present disclosure, an electrophoretic display system can, in various embodiments, include an electrophoretic display having controlled spreading of a set of electrically-charged electrophoretic particles using an electric field, where the set can be distributed in a number of electrophoretic pixels. In some embodiments, a plurality of (i.e., more than one) planar arrays of the number of electrophoretic pixels can, in various embodiments, be arranged in a number of x-y planes, where distributed subsets of electrically-charged electrophoretic particles are controllable to spread in-plane to each of the x-y planes.

In various embodiments, a different color can be used for a subset of the electrically-charged electrophoretic particles in at least one of the plurality of planar arrays of the number of electrophoretic pixels. By way of example and not by way of limitation, the different color for the subset in at least one of the plurality of planar arrays can include using separate subsets of the electrically-charged electrophoretic particles that reflect and/or transmit colors such as substantially cyan, magenta, yellow, and/or black.

However, planar arrays in agreement with the teachings of the present disclosure can, in various embodiments, include electrophoretic pixels having electrophoretic particles that reflect and/or transmit one or more colors, where any particular colors can be used, as can any combinations thereof. In addition, each planar array can, in various embodiments, be formed to include electrophoretic pixels having one or more colors reflected and/or transmitted by electrophoretic particles therein, whether such electrophoretic particle colors are separated in different and/or combined in the same electrophoretic pixels of the planar array.

The electrophoretic display system can include a stack along a z axis of the plurality of planar arrays of the number of electrophoretic pixels, where each of the planar arrays, in some embodiments, has a different color for the subset of the electrically-charged electrophoretic particles contained therein. Various embodiments of the electrophoretic display system, including the embodiment as just described, can be enabled by alignment of at least one display aperture in each of the number of electrophoretic pixels in each array such that electrophoretic pixels that spread across an area of a display aperture of a first planar array positioned below a second planar array are visible to a viewer.

In some embodiments, alignment of the display apertures having the different color for the subset of the electrically-charged electrophoretic particles in each planar array can, in various embodiments, enable image production with a gamut of colors through a color subtraction process. However, embodiments of the present disclosure are not limited to having a different color for the subset of the electrically-charged electrophoretic particles in each planar array.

An electrophoretic display system as described in the present disclosure can, for example, use a bottom planar array having an opaque and/or reflective backplane in which the electrophoretic pixels thereon each have a substantially transparent display aperture of the top surface. Each planar array placed on top of the bottom planar array can have a substantially transparent display aperture on a bottom surface, along with a substantially transparent substrate layer (e.g., including the backplane), layer of insulating dielectric material, and/or display electrode, and a substantially transparent display aperture on the top surface to enable passage therethrough of light reflected by electrophoretic particles in electrophoretic pixels of one or more planar arrays positioned underneath.

As such, the electrophoretic display system described in the present disclosure can, in various embodiments, include a number of components such as, among others: a backplane to at least one of the plurality of planar arrays of the number of electrophoretic pixels that is substantially transparent to facilitate emission through display apertures of light reflected by the set of electrically-charged electrophoretic particles; a backplane to at least one of the plurality of planar arrays of the number of electrophoretic pixels that is substantially opaque to facilitate emission through display apertures of light reflected by the set of electrically-charged electrophoretic particles; a backplane to at least one of the plurality of planar arrays of the number of electrophoretic pixels that is substantially reflective to facilitate emission through display apertures of light reflected by the set of electrically-charged electrophoretic particles; and/or backplanes to all of the plurality of planar arrays of the number of electrophoretic pixels that are substantially transparent to facilitate emission through display apertures of light transmitted through the set of electrically-charged electrophoretic particles from a backlight source.

An electrophoretic display having a number of planar arrays included in the system can, in various embodiments, be substantially constructed using roll-to-roll plastic. Roll-to-roll (R2R) processing can allow efficient manufacture of an electrophoretic display on a flexible substrate (e.g., plastic) at low cost and/or high speed. A continuous roll or web of, for example, the flexible plastic can be run through processing machinery and rollers that can be used to define the path taken and to maintain proper tension and/or position.

R2R processing can construct devices layer by layer and can allow building of connections between components, thereby forming a complete device, rather than a device to which connections are later attached and/or soldered. Using R2R processing can convert the display manufacturing process from inefficient batch production to continuous flow R2R high speed processing in which desired characteristics for the plastic, for example, can be incorporated. As such, the electrophoretic display can, in various embodiments, include a number of characteristics including flexibility, substantially non-filtered emitted light, and substantially non-polarized emitted light, among others.

As described in the present disclosure, having components (e.g., display apertures, display electrodes, etc.) that are substantially transparent to (e.g., do not filter and/or polarize) incident and/or emitted light, can allow individual electrophoretic pixels and/or aligned stacks thereof to provide more color intensity than, in some instances, electrophoretic display devices that do filter and/or polarize such light. In addition, by stacking and/or aligning such electrophoretic pixels (e.g., in planar arrays), combinations of electrophoretic particles that reflect and/or transmit different colors (e.g., cyan, magenta, yellow, and/or black) can subtractively reproduce an input color, in some instances, more closely and/or with higher intensity than an electrophoretic display device that uses a number of adjacent electrophoretic pixels that emit separate colors of light to additively reproduce the input color.

Fabricating and/or using an electrophoretic display device embodiment or method as described in the present disclosure can confer a number of advantages relative to electrophoretic displays as described in prior disclosures, such as the electrophoretic display illustrated in FIG. 1. For example, included among such advantages are possible use of less circuitry to form the pixel arrangement, enhanced bistability of the electrophoretic particles, increased density of the pixel array and/or a more compact arrangement of pixels for reproduction of input colors in which each pixel area can subtractively reproduce the desired color (rather than multiple pixels occupying a greater area for additive reproduction), among other advantages described in the present disclosure.

Although specific embodiments have been illustrated and described herein, those of ordinary skill in the relevant art will appreciate that an arrangement calculated to achieve the same techniques can be substituted for the specific embodiments shown. This disclosure is intended to cover all adaptations or variations of various embodiments of the present disclosure.

It is to be understood that the above description has been made in an illustrative fashion, and not a restrictive one. Combination of the above embodiments, and other embodiments not specifically described herein, will be apparent to those of ordinary skill in the relevant art upon reviewing the above description.

The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure need to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method of displaying electrophoretic particles, comprising:

configuring an electrophoretic display for directed spreading of electrophoretic particles across a number of substantially planar display electrodes by:

controlling planar spreading of the electrophoretic particles in an electrophoretic pixel with an electrical field between an in-plane storage electrode and an in-plane activation electrode; and connecting the in-plane activation electrode to an in-plane display electrode, which extends across a first area in the electrophoretic pixel adjacent to a display aperture having a second area that is substantially coextensive with the first area;

wherein the in-plane storage electrode and the in-plane activation electrode are positioned substantially coplanar with and at substantially opposite ends of the in-plane display electrode in an x-y plane and wherein the second area of the display aperture is positioned in a substantially z axis relative to the x-y plane of the in-plane display electrode.

2. The method of claim 1, where the method includes directing the electrophoretic particles to spread across the in-plane display electrode to become visible through the adjacent display aperture, which is positioned substantially coplanar to the in-plane display electrode.

3. The method of claim 1, where controlling spreading of the electrophoretic particles with the in-plane storage electrode includes storing the electrophoretic particles outside the first area of the display electrode, which is substantially coextensive with the second area of the display aperture.

4. The method of claim 1, where the method includes reducing a refresh rate of the in-plane storage electrode by associating the in-plane storage electrode with a storage capacitor.

5. The method of claim 1, where the method includes reducing a refresh rate of the in-plane storage electrode by associating the in-plane storage electrode with a parasitic capacitor connected to a gate electrode and a select line.

6. The method of claim 1, where the method includes positioning an in-plane semiconductor channel between the in-plane storage electrode and a data line and serving as a switch to increase control of the electrical field affecting the in-plane spreading of the electrophoretic particles.

7. The method of claim 1, where the method includes integrating an active matrix backplane having a number of gate electrodes for a plurality of thin film transistors with a number of electrophoretic pixels having the remaining components of the plurality of thin film transistors by positioning an in-plane semiconductor channel on an in-plane surface of each electrophoretic pixel to form a plurality of bottom gate thin film transistors.

8. The method of claim 7, where the method includes positioning the in-plane semiconductor channel of the bottom gate thin film transistor, the in-plane storage electrode, the in-plane activation electrode, and the in-plane display electrode on the in-plane surface of each electrophoretic pixel.

9. The method of claim 7, where positioning the in-plane semiconductor channel of the bottom gate thin film transistor on the in-plane surface includes promoting formation and growth of in-plane semiconductor crystal structures on the in-plane surface of each electrophoretic pixel.

10. A non-transitory medium having executable instructions stored thereon for executing a method of displaying electrophoretic particles in an electrophoretic display apparatus, comprising:

controlling spreading of electrophoretic particles in an x-y plane across a display electrode using electrical pulses transmitted to an electrophoretic pixel, wherein the spreading is between substantially opposite ends of the display electrode in the x-y plane relative to a display aperture that is positioned in a substantially z axis relative to the x-y plane of the display electrode;

transmitting a first set of the electrical pulses from a data line to a source terminal for a transistor and then to an in-plane storage electrode, where the in-plane storage electrode is connected to a storage capacitor; and transmitting a second set of electrical pulses, having been modulated by coupling through a parasitic capacitor connected to a drain terminal of the transistor when a select line activates a thin film transistor switch.

11. The non-transitory medium of claim 10, where using electrical pulses transmitted to an electrophoretic pixel includes transmitting the electrical pulses through a bidirectional bottom gate thin film transistor.

12. The non-transitory medium of claim 11, where transmitting the electrical pulses through the bidirectional bottom gate thin film transistor includes transmitting the electrical pulses through a multicomponent oxide semiconductor channel.

13. The non-transitory medium of claim 10, where the method includes providing a bistable electrical field that reduces a refresh rate to maintain a position of the electrophoretic particles by using the storage capacitor and the parasitic capacitor.

14. The non-transitory medium of claim 10, where the method includes using the in-plane storage electrode to control whether the electrophoretic particles are allowed to spread across the display electrode and become visible to a viewer through a display aperture that is substantially coplanar to and coextensive with the display electrode.

15. The non-transitory medium of claim 10, where the method includes using a third subset of electrical pulses, which is transmitted to the in-plane activation electrode, to control a manner of in-plane spreading of the electrophoretic particles across the display electrode that is connected to the in-plane activation electrode.

16. The non-transitory medium of claim 15, where controlling the manner of in-plane spreading of the electrophoretic particles includes using electrical pulse modulation selected from a group including:

using a number of incremental voltage levels, where the number ranges from two voltage levels to 256 voltage levels, transmitted to the display electrode;

using a varying time span of a particular voltage transmitted to the display electrode;

using a varying time span of the number of incremental voltage levels transmitted to the display electrode; and using waveform diffusion mechanisms.

17. An electrophoretic display system, comprising:

an electrophoretic display for controlled spreading of a set of electrically-charged electrophoretic particles using an electric field, where the set is distributed in a number of electrophoretic pixels;

a plurality of planar arrays of the number of electrophoretic pixels arranged in an x-y plane, where distributed subsets of electrically-charged electrophoretic particles are controllable to spread in-plane to the x-y plane between substantially opposite ends of an in-plane display electrode in the x-y plane relative to a display aperture that is positioned in a substantially z axis relative to the x-y plane of the in-plane display electrode; and a different color for a subset of the electrically-charged electrophoretic particles in at least one of the plurality of planar arrays of the number of electrophoretic pixels.

18. The system of claim 17, where the different color for the subset in at least one of the plurality of planar arrays includes separate subsets of the electrically-charged electrophoretic particles that reflect or transmit colors that include substantially cyan, magenta, yellow, and black.

19. The system of claim 17, where the system includes a stack along a z axis of the plurality of planar arrays of the number of electrophoretic pixels, where each of the planar arrays has the different color for the subset of the electrically-charged electrophoretic particles.

20. The system of claim 19, where the system includes alignment of at least one display aperture in each of the number of electrophoretic pixels in each array such that electrophoretic pixels spread across an area of a display aperture of a first planar array positioned below a second planar array are visible to a viewer.

21. The system of claim 20, where alignment of the display apertures having the different color for the subset of the electrically-charged electrophoretic particles in each array includes enablement of image production with a gamut of colors through a color subtraction process.

22. The system of claim 20, where the system includes a number of components selected from a group including:

a backplane to at least one of the plurality of planar arrays of the number of electrophoretic pixels that is substantially transparent to facilitate emission through display apertures of light reflected by the set of electrically-charged electrophoretic particles;

a backplane to at least one of the plurality of planar arrays of the number of electrophoretic pixels that is substantially opaque to facilitate emission through display apertures of light reflected by the set of electrically-charged electrophoretic particles;

a backplane to at least one of the plurality of planar arrays of the number of electrophoretic pixels that is substantially reflective to facilitate emission through display apertures of light reflected by the set of electrically-charged electrophoretic particles; and backplanes to all of the plurality of planar arrays of the number of electrophoretic pixels that are substantially transparent to facilitate emission through display apertures of light transmitted through the set of electrically-charged electrophoretic particles from a backlight source.

23. The system of claim 17, where the electrophoretic display includes being substantially constructed using roll-to-roll plastic, such that the electrophoretic display includes a number of characteristics selected from a group including:

flexibility;

substantially non-filtered emitted light; and substantially non-polarized emitted light.

* * * * *